US010364114B2

(12) United States Patent
Perini

(10) Patent No.: US 10,364,114 B2
(45) Date of Patent: Jul. 30, 2019

(54) DEVICE FOR HANDLING PAPER REELS IN PAPER CONVERTING PLANTS

(71) Applicant: FUTURA S.P.A., Capannori (LU), Fraz. Guamo (IT)

(72) Inventor: Fabio Perini, Viareggio (IT)

(73) Assignee: FUTURA S.P.A., Capannori (LU), Fraz, Guamo (IT)

( * ) Notice: Subject to any disclaimer, the term of this patent is extended or adjusted under 35 U.S.C. 154(b) by 159 days.

(21) Appl. No.: 15/512,758

(22) PCT Filed: Sep. 17, 2015

(86) PCT No.: PCT/IT2015/000234
§ 371 (c)(1),
(2) Date: Mar. 20, 2017

(87) PCT Pub. No.: WO2016/046856
PCT Pub. Date: Mar. 31, 2016

(65) Prior Publication Data

US 2017/0240370 A1 Aug. 24, 2017

(30) Foreign Application Priority Data

Sep. 23, 2014 (IT) ..... FI2014A0217

(51) Int. Cl.
*B65H 19/30* (2006.01)
*B65H 26/00* (2006.01)

(52) U.S. Cl.
CPC ..... *B65H 19/30* (2013.01); *B65H 26/00* (2013.01); *B65H 2301/41346* (2013.01); *B65H 2301/41732* (2013.01); *B65H 2405/422* (2013.01); *B65H 2405/423* (2013.01); *B65H 2511/15* (2013.01); *B65H 2515/31* (2013.01); *B65H 2553/212* (2013.01); *B65H 2801/84* (2013.01)

(58) Field of Classification Search
CPC ..... B65H 19/30; B65H 26/00; B65H 2301/41346; B65H 2301/41732; B65H 2405/422; B65H 2405/423; B65H 2511/15; B65H 2515/31; B65H 2553/212
See application file for complete search history.

(56) References Cited

U.S. PATENT DOCUMENTS

| | | | | |
|---|---|---|---|---|
| 5,308,217 | A | 5/1994 | Pienta | |
| 2005/0017118 | A1* | 1/2005 | Finetti | B65H 19/126 242/559.1 |
| 2017/0240378 | A1* | 8/2017 | Perini | B65H 75/242 |

FOREIGN PATENT DOCUMENTS

| | | | | |
|---|---|---|---|---|
| DE | 10241805 | A1 * | 4/2004 | B66C 1/28 |
| EP | 1 136 406 | A2 | 9/2001 | |
| WO | 2010/149847 | A1 | 12/2010 | |

* cited by examiner

*Primary Examiner* — Dale Moyer
(74) *Attorney, Agent, or Firm* — McGlew and Tuttle, P.C.

(57) ABSTRACT

Device for handling paper reels, comprising a bridge crane (CP) with movable arms (BC) each of which is adapted to engage a pin (P) insertable into a corresponding side of a reel (1) and a platform (PB) adapted for supporting the reel (1). The device further comprises detection means adapted to detect load variations on said arms (BC) during insertion of the pins (P) inside the reel (1), and moving means adapted to achieve a relative movement between the reel (1) and the arms (BC) when the absolute value of a variation of the load detected by said detection means exceeds a predetermined limit up to bring said value below the predetermined limit.

8 Claims, 15 Drawing Sheets

DEVICE FOR HANDLING PAPER REELS IN PAPER CONVERTING PLANTS

The present invention relates to a device for handling paper reels in paper converting plants.

It is known that the production of paper logs implies the feeding of a continuous paper web along a predetermined path. The paper web is transversely perforated at a predetermined point of said path so that it is divided into sheets of predetermined length separable by tearing. Furthermore, use is made of tubular elements (commonly said cores) on whose surface is applied a predetermined amount of glue to allow the glueing of the first sheet of the log to be formed. Moreover, use is made of winding rollers, positioned and acting in logs formation station, that cause the rotation of the core on which the paper is wound. The formation of a log ends when a given amount of paper is wound on the core. Then, another log is formed. When the formation of a log is completed, the last sheet of the log must be glued on the underlying sheet to avoid the spontaneous unwinding of the log. Each log is then subdivided into a plurality of shorter rolls by means of cutting-off machines.

In order to permit the proper running of the process, a paper converting plant always comprises an unwinder where are positioned the parent reels from which the paper web is fed. Moreover, a paper converting plant normally comprises a bridge crane by means of which the parent reel is moved from a parking position to the unwinder.

During the removal of the parent reel from the respective parking point, the arms of the bridge crane are not always properly aligned with the reel core, that is, the ends of said arms are above or below the axis of the reel.

The main object of the present invention is to avoid the above-mentioned drawback.

This result is achieved, according to the present invention, by providing a device having the features indicated in claim 1. Other features of the present invention are the subject of the dependent claims.

A production system according to the present invention always allows the proper alignment the axis of the parent reel to be removed with the ends of the arms of which the bridge crane is provided, whatever be the diameter of the parent reel. Furthermore, a system according to the present invention can be easily implemented in exixting paper converting plants and is not expensive in relation to the advantages offered.

These and other advantages and features of this invention will be best understood by anyone skilled in the art thanks to the following description and to the attached drawings, provided by way of example but not to be considered in a limiting sense, in which:

FIG. 1 schematically shows a side view of a bridge crane with the ends of the respective arms properly aligned with the longitudinal axis of a parent reel positioned on a support;

FIG. 9 is a cross section view of the pin (P) and FIG. 10 is a section along line A-A of FIG. 9;

Figure 15A:
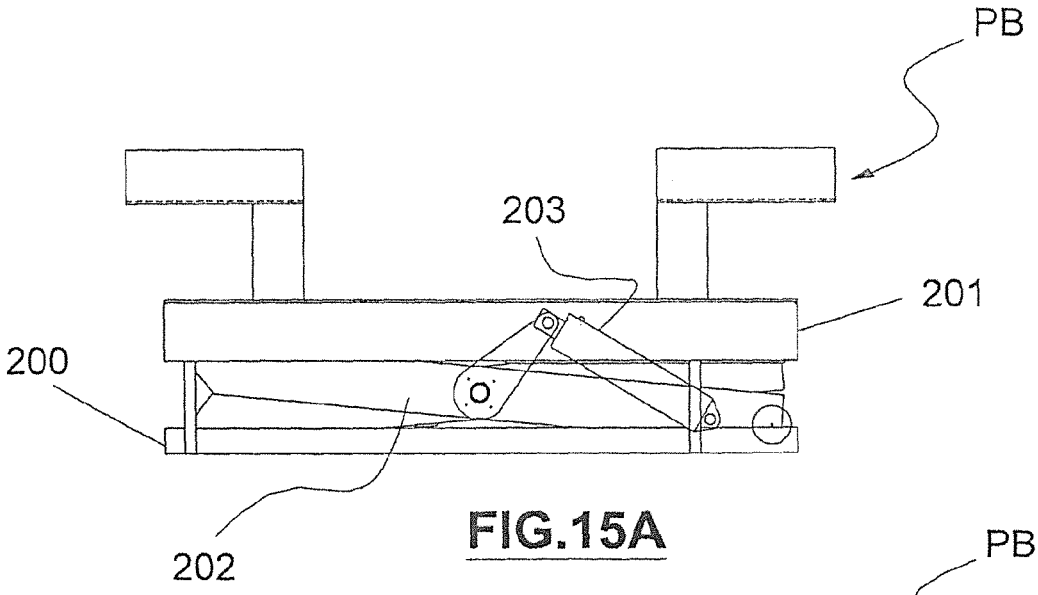
Figure 15B:
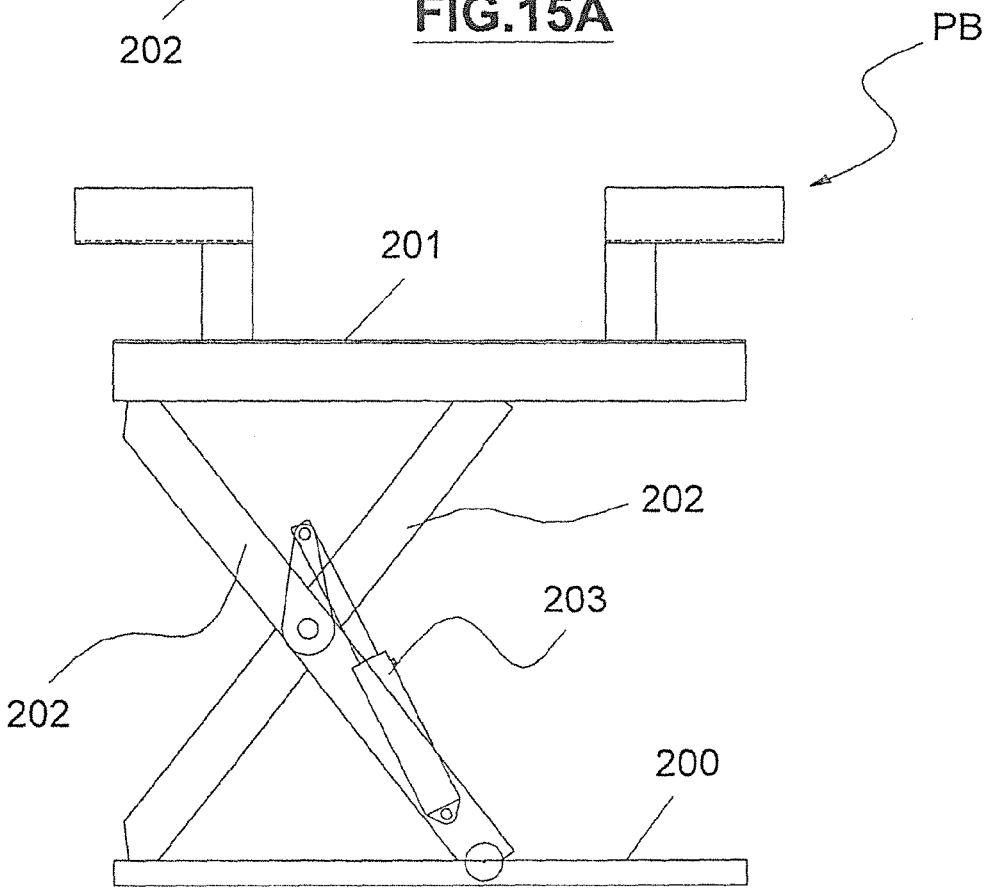
Figure 17:
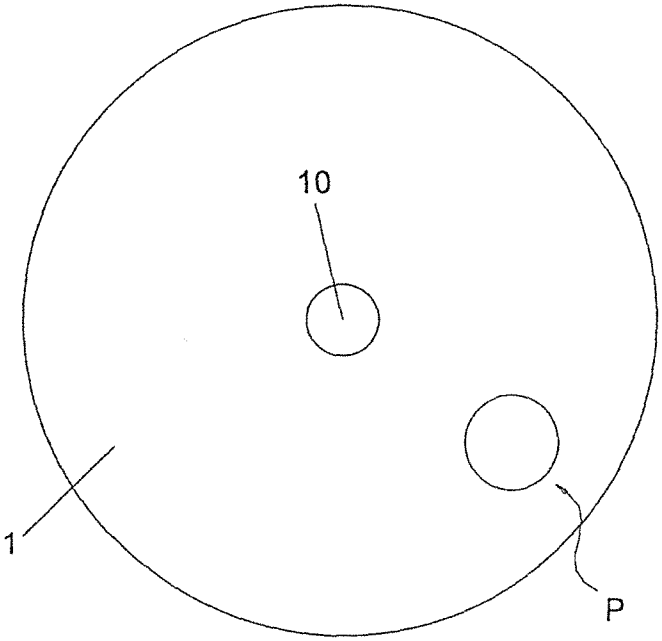
Figure 16:
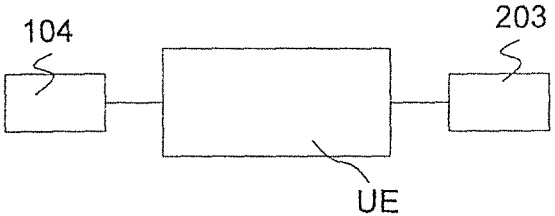

FIGS. 15A and 15B schematically show the platform (PB) in the lowered and respectively raised platform;

FIG. 16 is a schematic block diagram of a possible automatic control system that can be used in connection with a device according to the present invention;

FIG. 17 shows a wrong position of a pin with respect to the parent reel.

In the following description reference is made to expandable "pins" (P) that are inserted into the core (10) of a parent reel (1) while the same pins (P) are still hooked to the mobile arms (BC) of a bridge crane (CP).

More particularly, the pin (P) has an outer side (PX) and an inner side (PN), the inner side (PN) being destined to be inserted into the core (10) of the reel (1) and the outer side being external to the same reel (1) when the inner side (PN) is inside the core (10).

Figure 1:
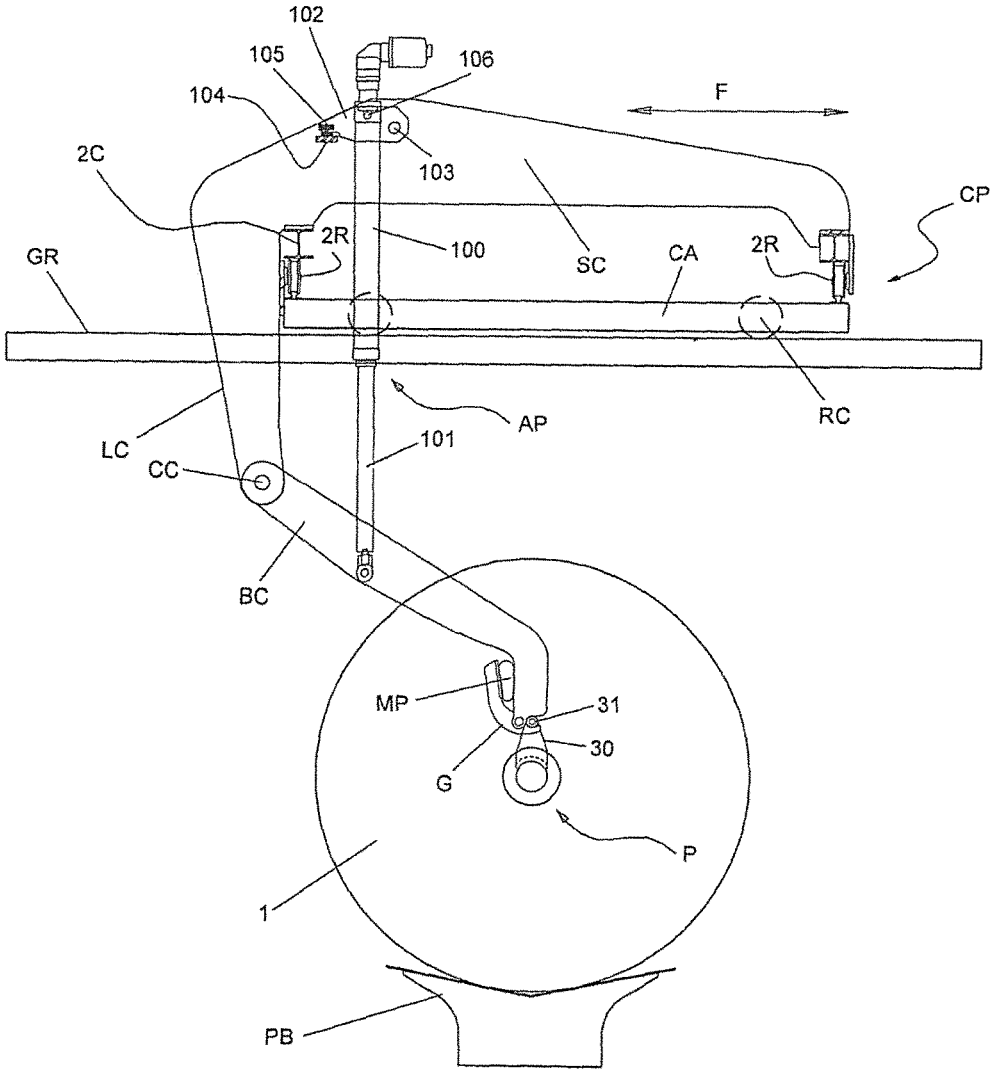
Figure 2A:
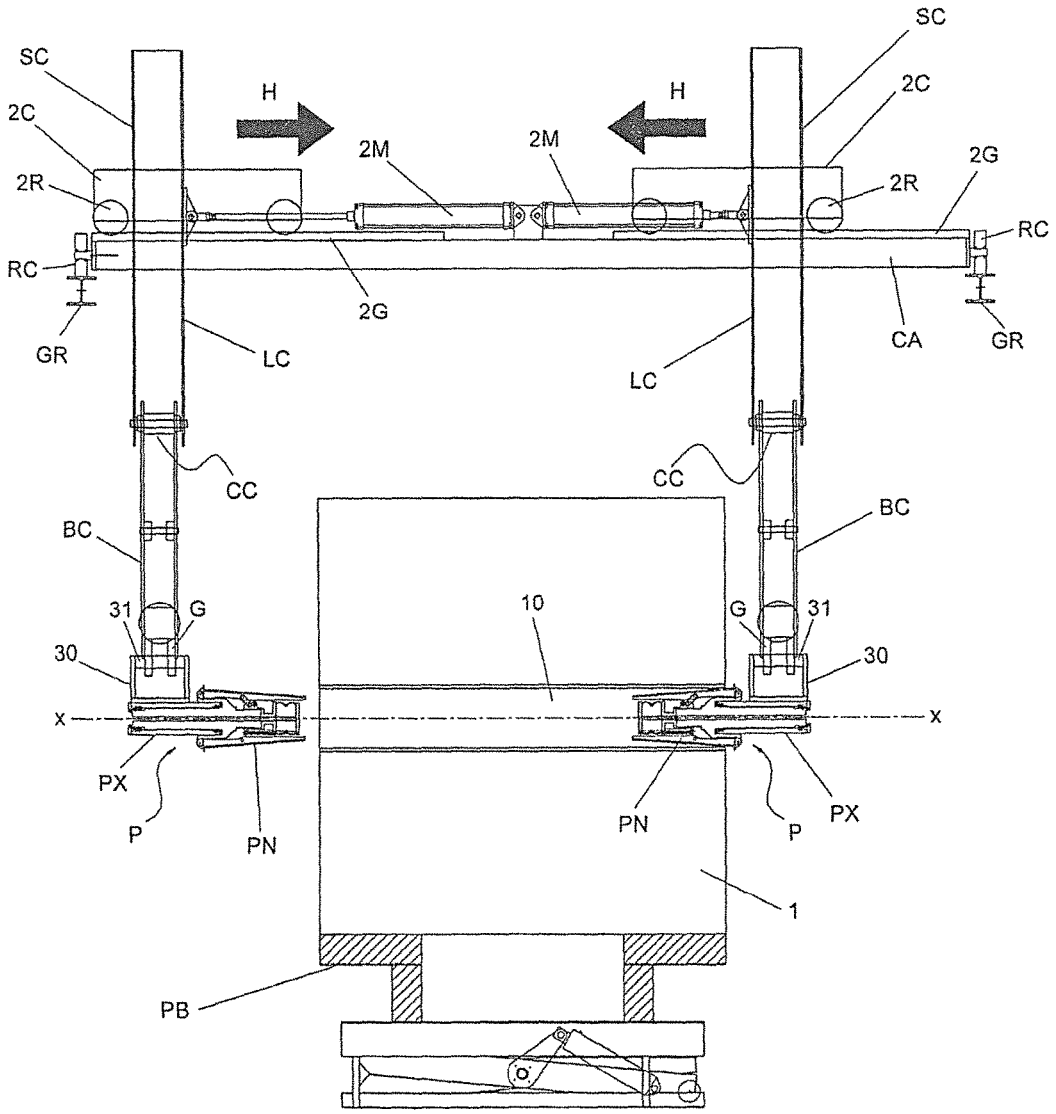
FIGS. 2A and 2B show the group of FIG. 1 in front view in two different configurations.
Figure 2B:
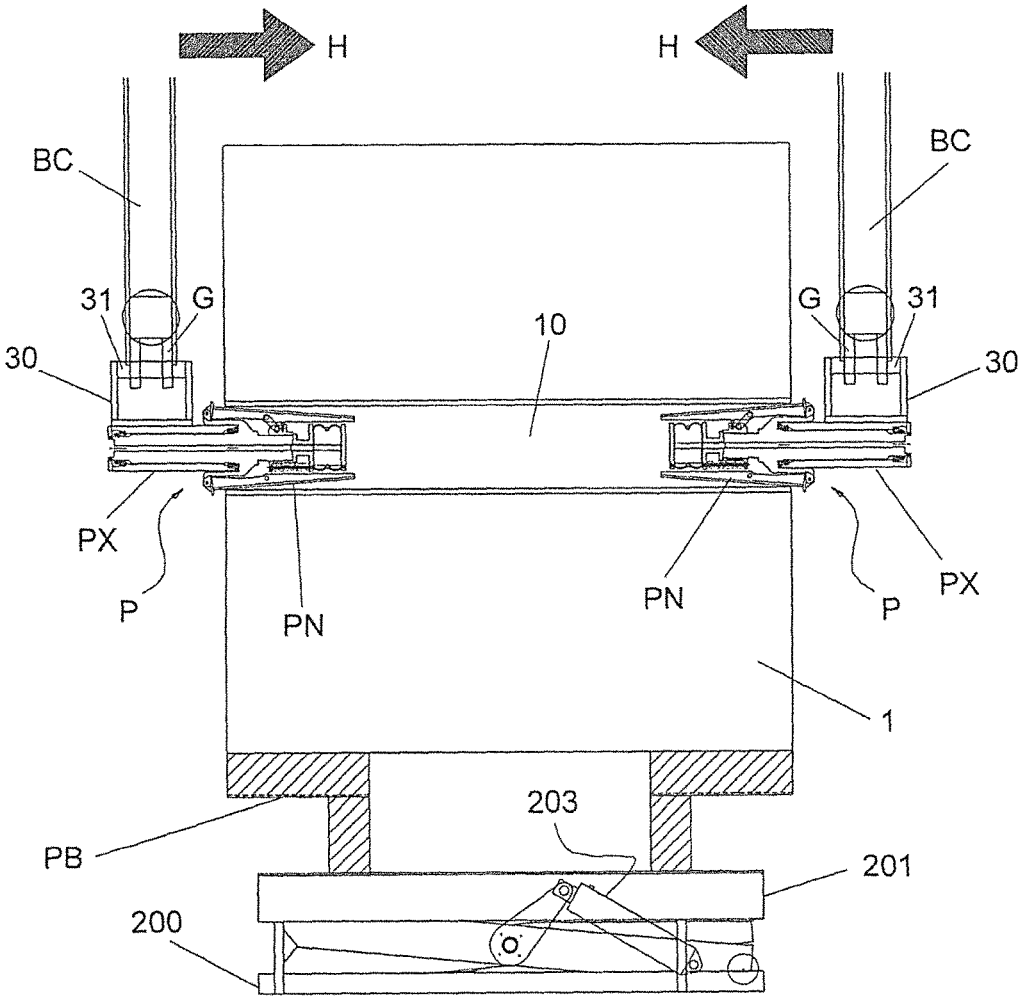
Figure 3:
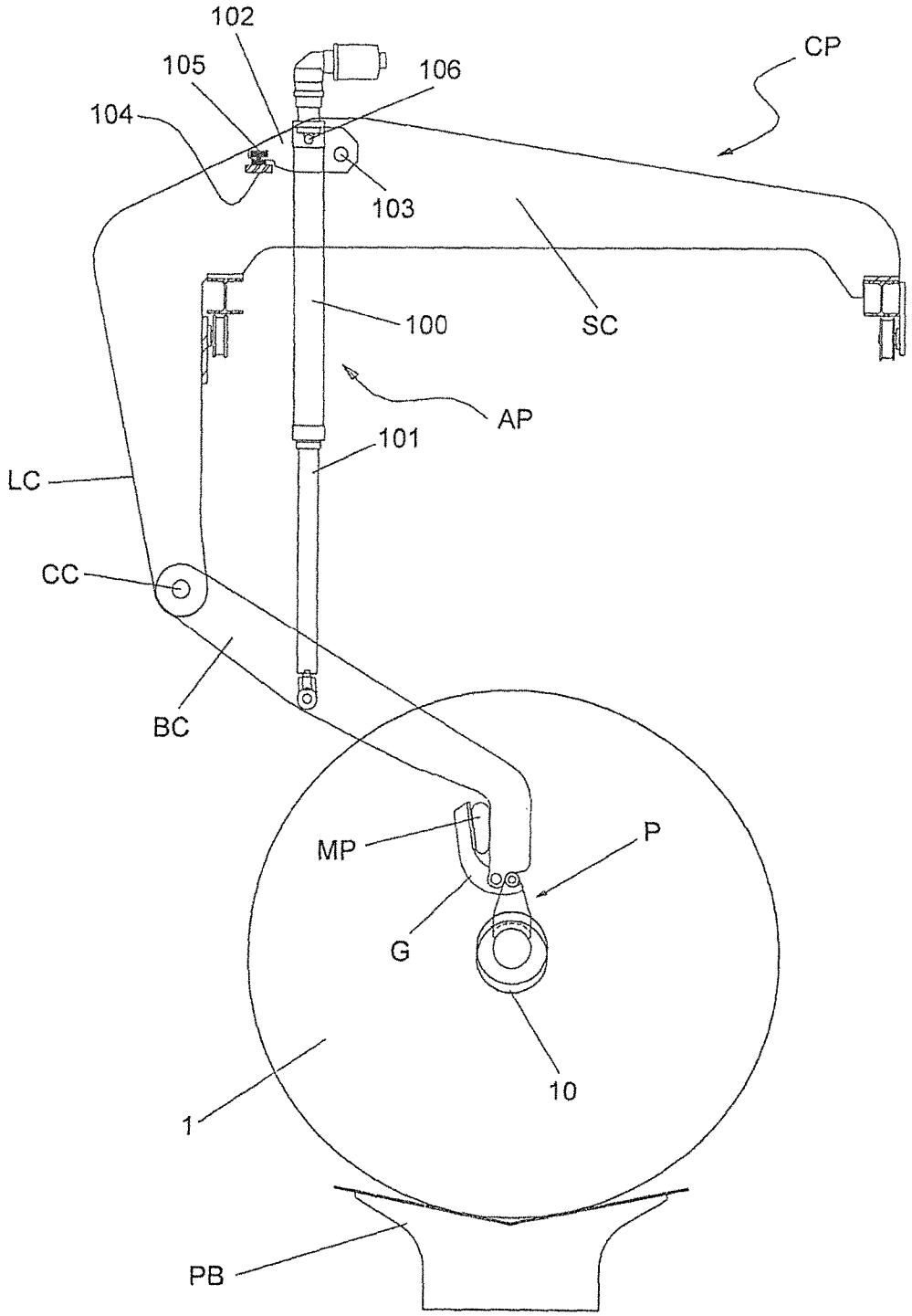
FIG. 3 is a schematic side view of the bridge crane with the ends of the respective arms above the longitudinal axis of the parent reel.
Figure 4:
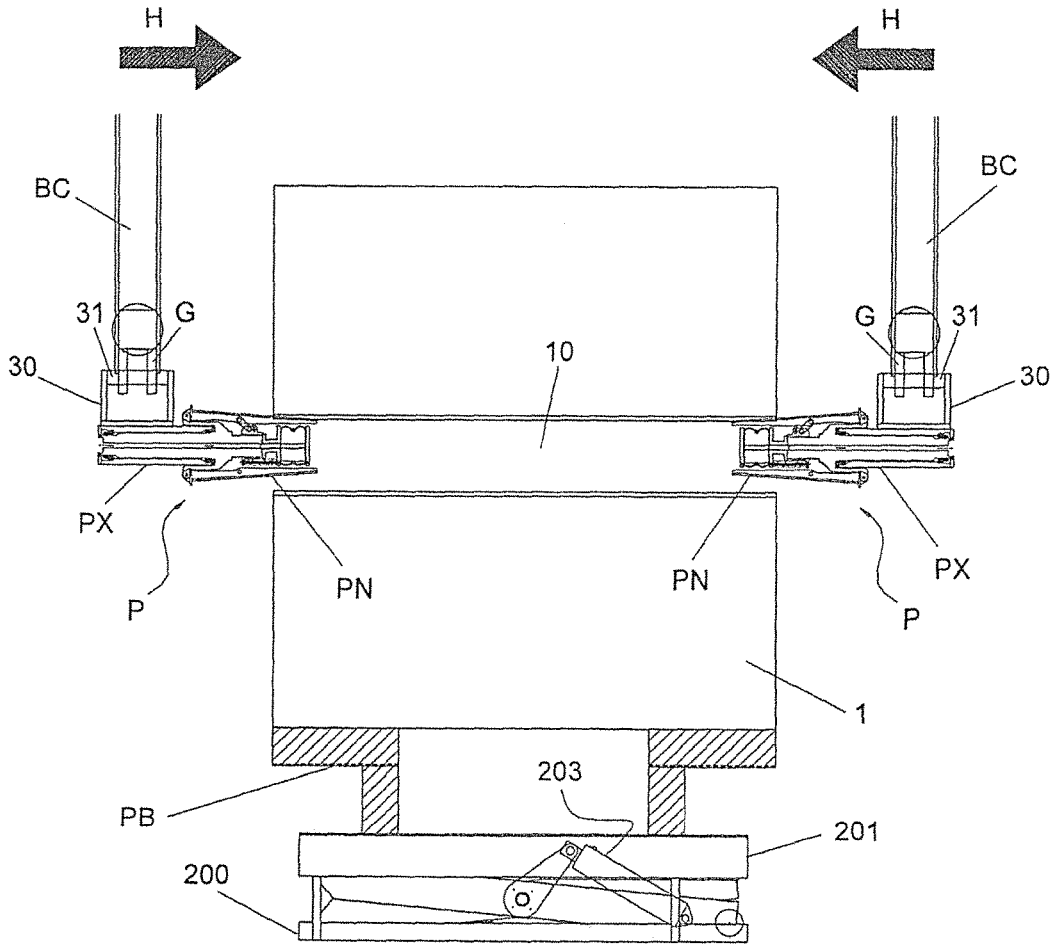
FIG. 4 shows the group of FIG. 3 in front view.
Figure 5:
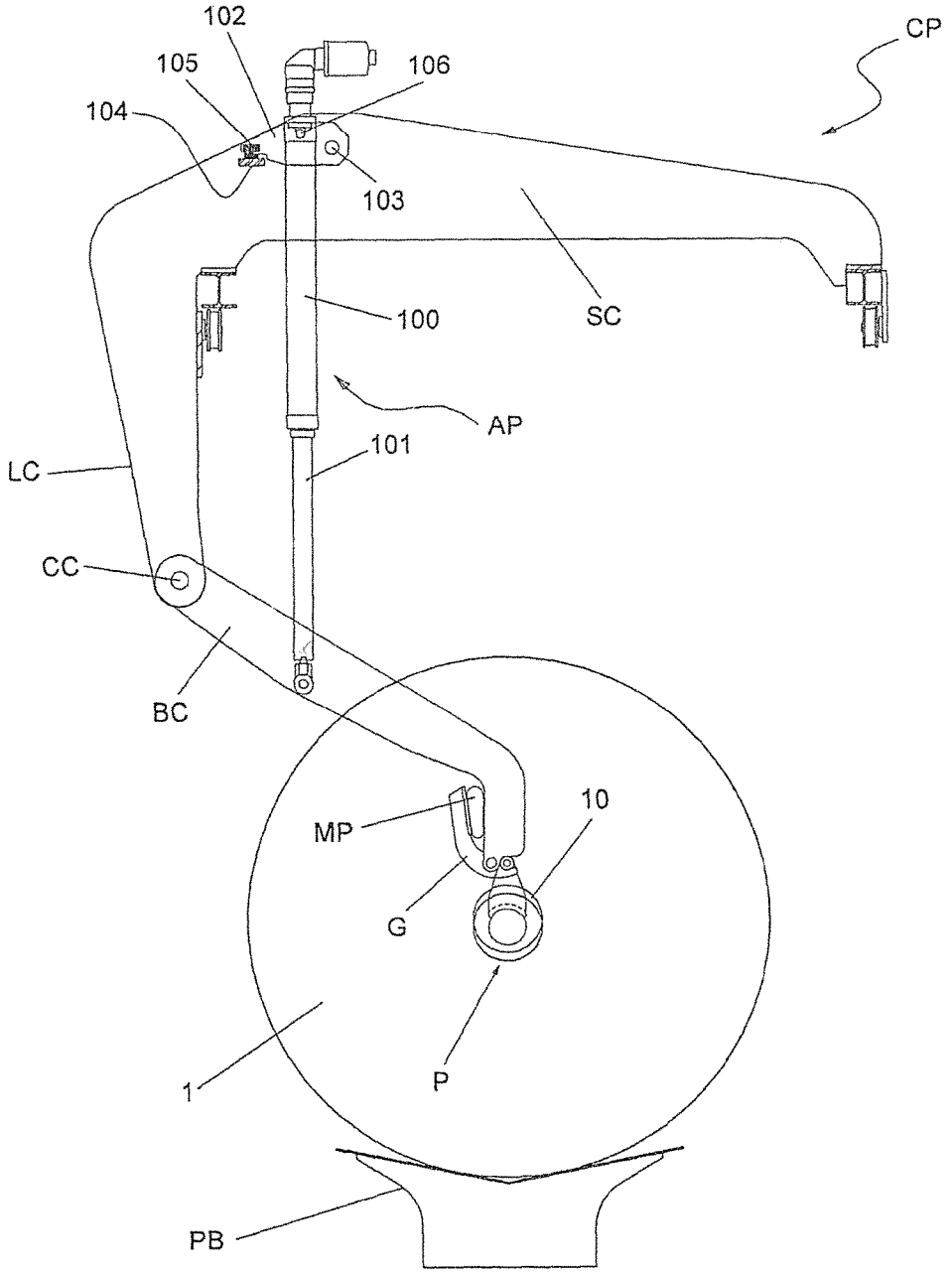
FIG. 5 is a schematic side view of the bridge crane with the ends of the respective arms below the longitudinal axis of the parent reel.
Figure 6:
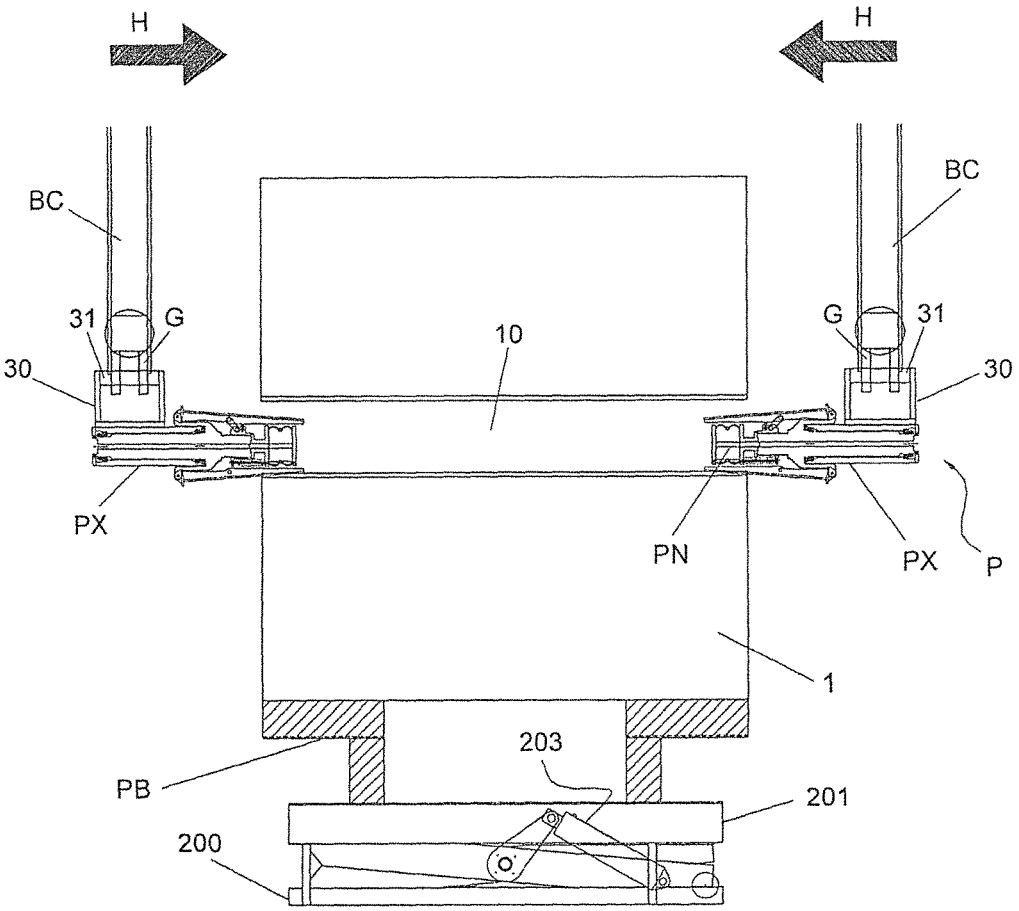
FIG. 6 shows the group of FIG. 5 in front view.
Figure 7:
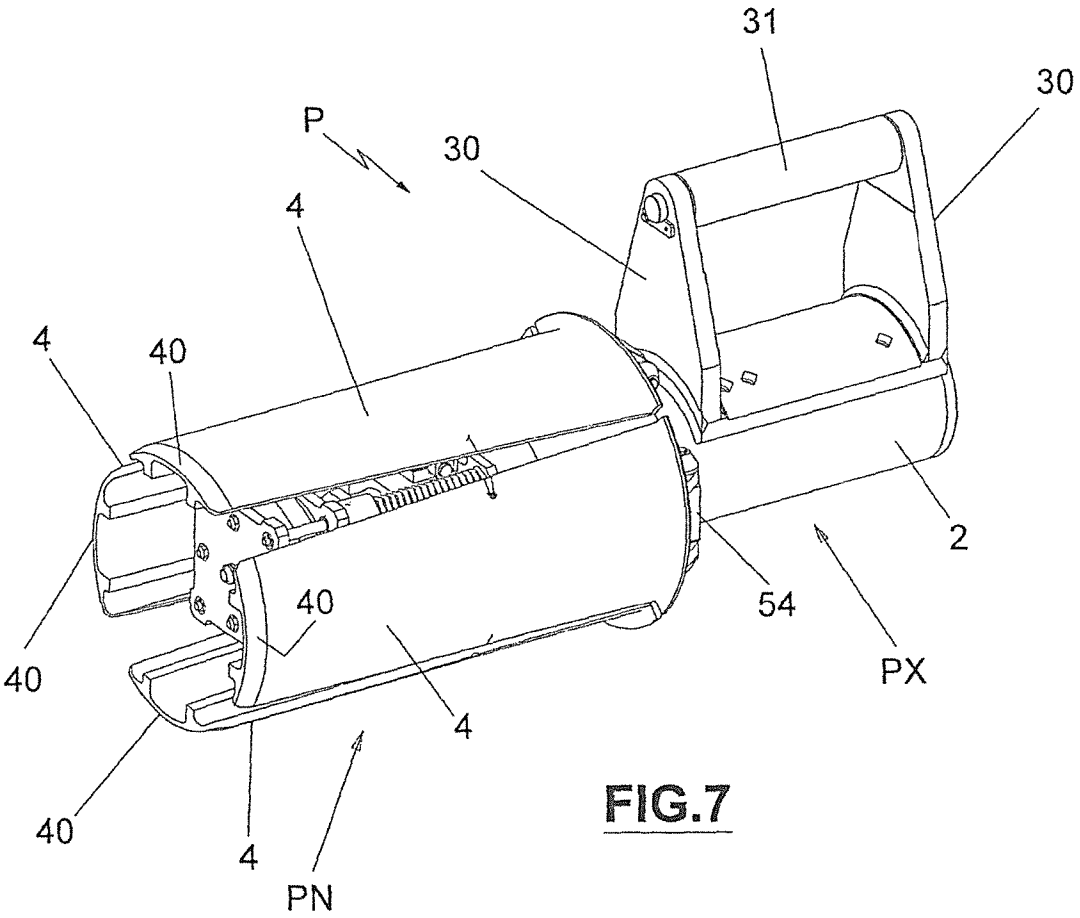
FIGS. 7-12 show several views of a pin (P) that can be inserted in the core of a parent reel, wherein, in particular.
Figure 8:
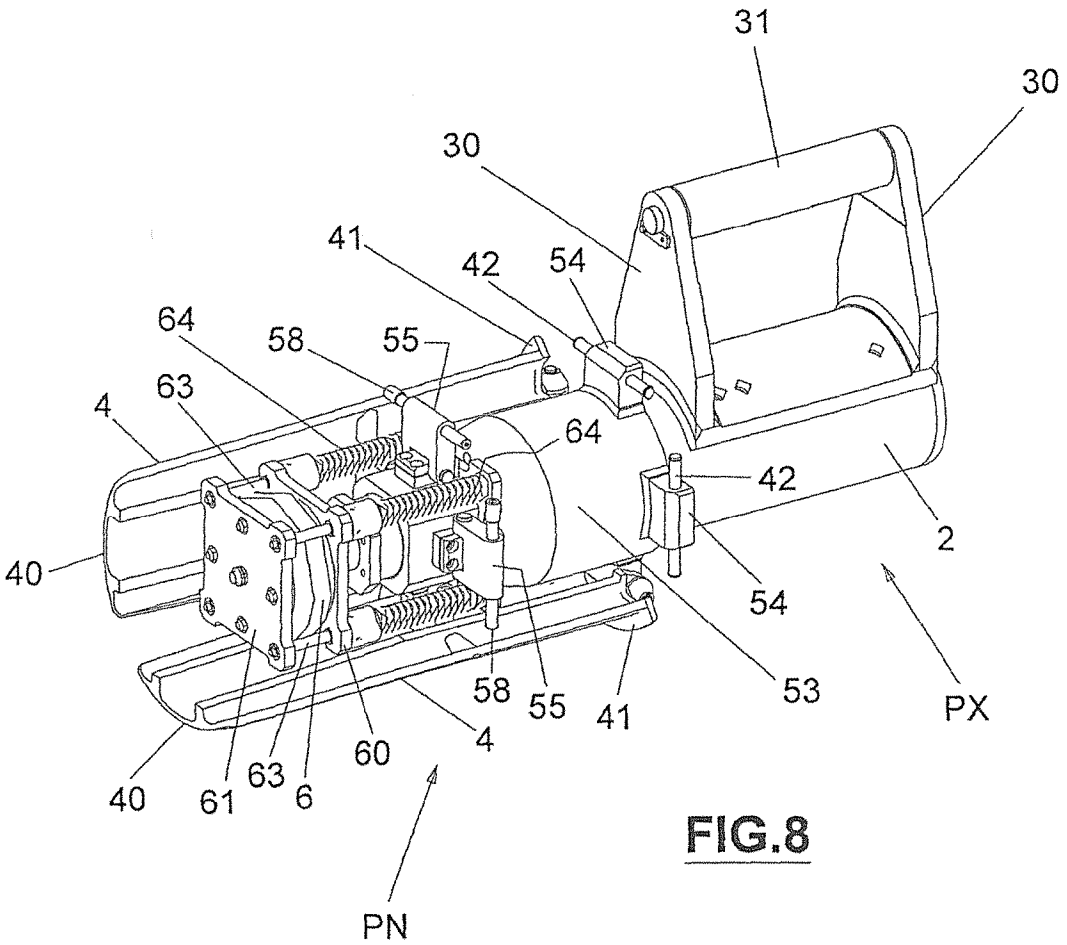
Figure 12:
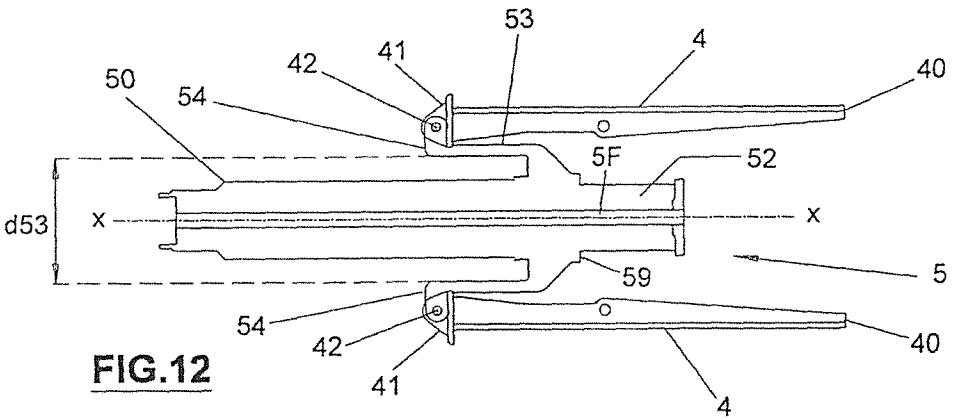
Figure 9:
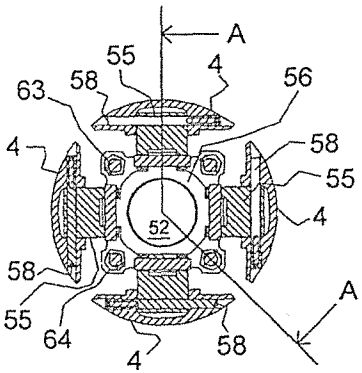
Figure 10:
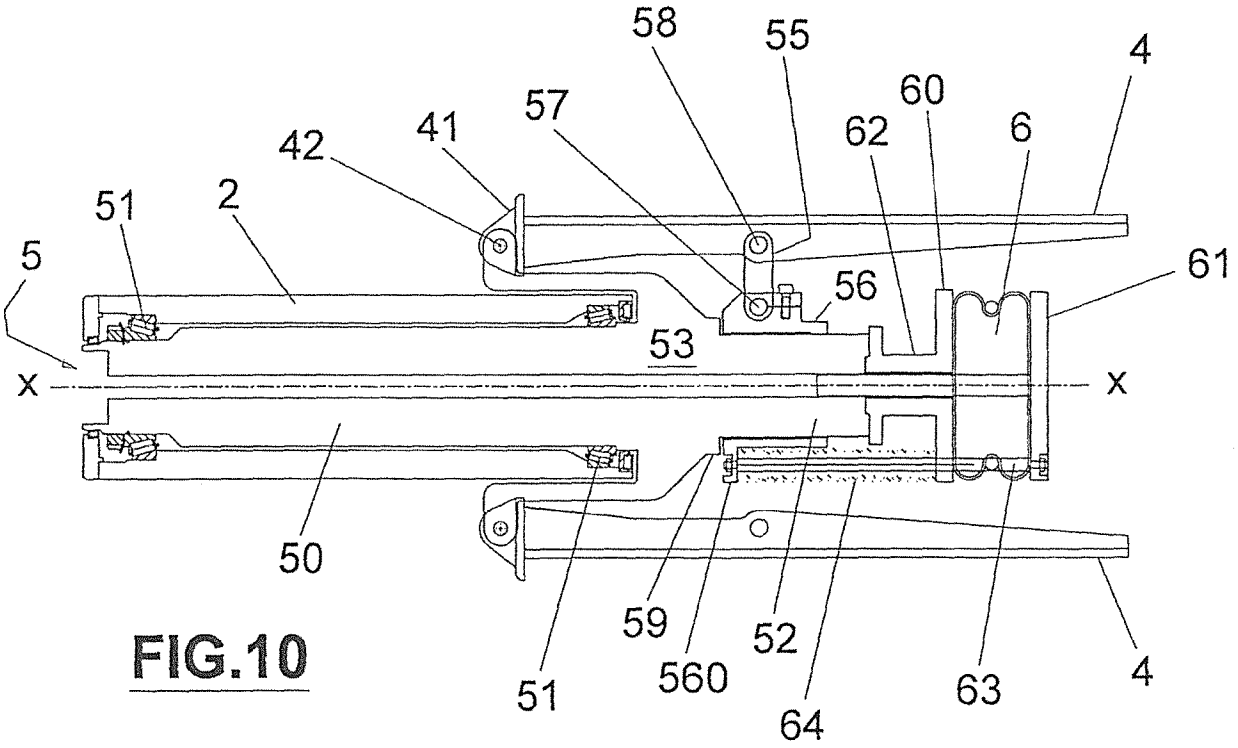

In FIG. 7 and FIG. 8 the outer side (PX) is on the right while the inner side (PB) is on the left. The pin (P) is substantially simmetrical with respect to a central longitudinal axis (x-x).

Figure 11:
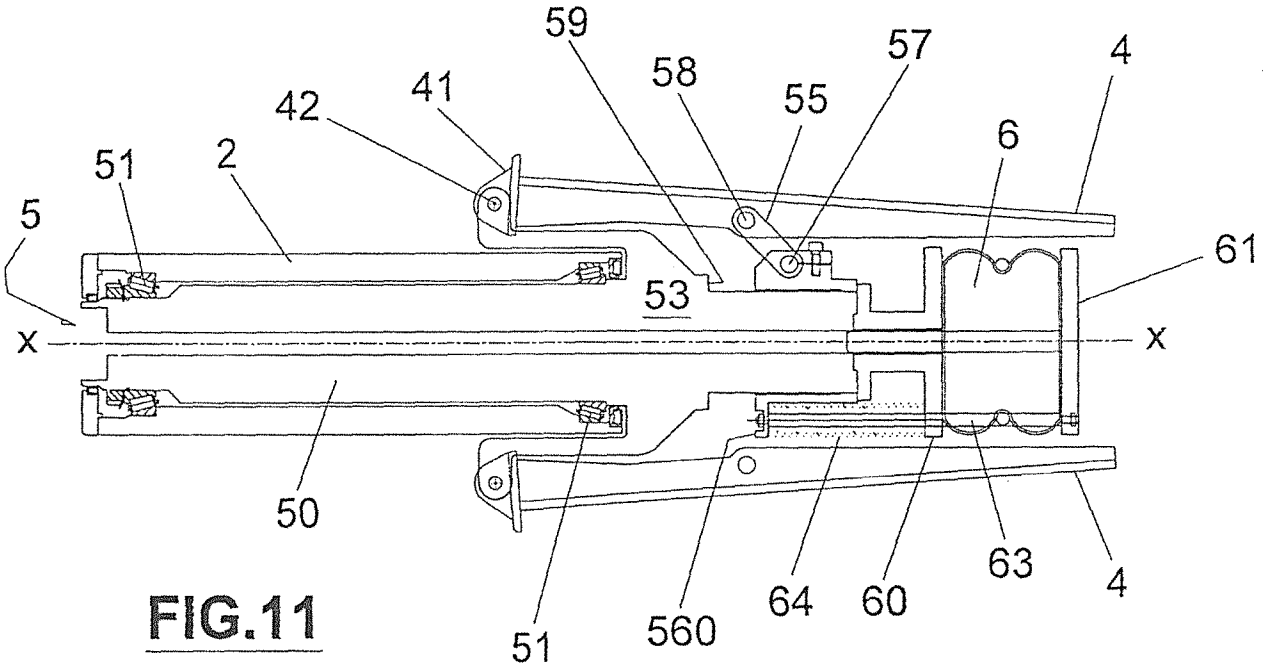

The outer side (PX) of the pin (P) is constituted by a shank (2) whose longitudinal axis coincides with the longitudinal axis (x-x) of the pin (P). On said shank (2) is fixed a handle (3), formed by two parallel arms (30) emerging radially from the shank (2) and joined by a body (31) parallel to said longitudinal axis (x-x). The handle (3) is applied on the upper side of the shank (2), i.e. on the side of the latter which, in operation, is turned upwards. The shank (2) is hollow. According to the example shown in FIGS. 7-12, According to the example shown in the drawings, the inner side (PN) of the pin (P) is expandable: said inner side is expanded (as shown in FIG. 7, FIG. 8, FIG. 9A, FIG. 9B and FIG. 10) when it is inserted in the core (10) of the reel (1) so as to engage the latter, while it is compressed (as shown in FIG. 11) in order to be inserted in the core (10) or disengaged from the reel. The outer surface of the inner side (PN) is formed by more sectors (4), four in number in this example, each of which is formed by a portion of cylindrical surface with a free front end (40) and a rear end (41). The pin (P) also comprises a body (5) having: a rear part (50) inserted longitudinally in the hollow shank (2) with the interposition of bearings (51); a front part (52) turned towards the front end (40) of the sectors (4) and consisting of a longitudinal extension of the rear part (50); and an outer cup-shaped part (53), whose inner diameter (d53) is greater than the outer diameter of the shank (2), at an intermediate point between the rear part (50) and the front part (52). In practice, the rear part (50) of body (5) is inserted in the shank (2), the intermediate part (53) is external to the shank that in part (i.e. on its most advanced part) is inside the cup-shaped intermediate part (53), and the front part (52) constitutes a prolongation of the body (5) that, as shown in the drawings, is internal to the sectors (4).

The rear end (41) of each sector (4) is constrained to the cup (53) of the body (5) by a pin (42) inserted in a radial wing (54) projecting externally from the same cup (53). Said wings (54), in this example, are four in number and are arranged at an angular distance of 90° from each other. The axis of each pin (42) is oriented along a tangential direction relative to the shank (2) whose surface is cylindrical. In addition, each pin (42) is spaced apart a predetermined value from the outer surface of the shank (2), being inserted in a wing (54) which acts as a spacer.

the sectors (4) are identical to each other and are separated by separation lines or discontinuities (S4) so as to allow their movement (as further described below) without interference. Furthermore, in the example, each of the sectors (4), seen from above, has a trapezoidal shape with the larger base in correspondence with its rear side (41).

Each sector (4) is also constrained to the front part (52) of said body (5) via a connecting rod (55) hinged on one side (lower side) on a collar (56) mounted longitudinally slidable on the front (52) of the body (5) and, on the opposite side (upper side), on the inner surface of the respective sector (4). The connection of the connecting rod (55) to the collar (56) is formed by a pin (57) whose axis is parallel to the pin (42) that connects the rear part (41) of the sector (4) to the respective wing (54) of the cup (53); the connection of the same connecting rod (55) to the inner side of the sector (4) is made by means of a further pin (58) parallel to the previous one (57).

In front of the front end of the front part (52) of the body (5) is arranged a pneumatic spring (6) placed between two plates (60, 61) that are orthogonal to said axis (x-x). The first plate (60) has a rear extension (62) which acts as a spacer and is fixed to the front end of the front part (52) of the body (5). The second plate (61) is on the opposite side with respect to the pneumatic spring (6). Several rods (63) connect the second plate (61) with said collar (56): each rod (63) is fixed on one side to the second plate (61) and, on the opposite side, to a rear appendix (560) of the collar (56) and passes freely through a respective hole formed in the first plate (60). On each of the rods (63) is mounted a helical spring (64). The rods (63) and the helical springs (64) are oriented parallel to said axis (x-x) and are four in number in the example shown in the drawings.

When the pneumatic spring (6) is discharged, that is, compressed, the action of the helical springs (64) is such as to maintain the collar (56) set back on the part (52) of the body (5): in this condition the rear part of the collar (56) is pushed by the springs (64) against an abutment surface (59) exhibited by the body (5) between its intermediate part (53) and the front part (52), and the sectors (4) are open, with the connecting rods (55) oriented along a radial direction, relative to the axis (x-x), that is oriented parallel to the load acting on the pin (P).

The sectors (4) are normally open.

When the pneumatic spring (6) is charged, i.e. expanded, the resistance of the springs (64) is overcome and the collar (56) advances, together with the foot of the connecting rods (55), whereby the sectors (4) are closed with reciprocal approaching of the respective front ends (40).

The compressed air is introduced into the pneumatic spring (6), or removed, through a longitudinal through hole (5F) formed in the body (5). In this way, the sectors (4) can be opened and closed by rotating them about the pins (42).

FIGS. 1-6 show a bridge crane (CP) provided with mobile arms (BC) and a platform (PB) on which is positioned a reel (1) to be removed.

The bridge crane (CP) has each of two arms (BC) each of which is connected, by a hinge with horizontal axis (C-C), to a lower appendix (LC) of a superstructure (SC). The latter is mounted on a carriage (CA) slidably mounted (by means of an electric motor not shown in the drawings, in a conventional manner) along a rectilinear guide (GR) placed at a predetermined height with respect to the lower base of the platform (PB). The guide (GR) is shown only in FIG. 1 and FIG. 2, where the references "RC" indicate the wheels of the carriage (CA) able to slide on the beams that form the guide (GR), while in the other figures it is not represented for simplicity. The two superstructures (SC), and the related appendices (LC) and the movable arms (BC), can be mutually approached or moved away, that is, can be moved orthogonally to the sliding direction (F) of the bridge crane (CP) along the guide (GR). In FIG. 22, FIG. 24 and FIG. 26 arrows (H) represent the mutual approach of the arms (BC) during insertion of the pins (P) engaged to them in the respective end of the core (10) of the reel (1). For this purpose, each of the two superstructures (SC) is integral with a second carriage (2C) equipped with wheels (2R) sliding on guides (2G) presented by the top surface of the first carriage (CA). The carriages (2C) each is controlled by a related jack (2M) which controls its translation along the guides (2G) on the upper side of the first carriage (CA) that are developed along a direction orthogonal to that of the beams that define the guide (GR) on which runs the first carriage (CA). Each jack (2M) is fixed with his mantle to a bracket fixed in central position on the first carriage (CA) and with the stem connected to an inner side of the respective superstructure (SC). In this way, each of the said superstructures (SC), with the respective arm (BC), can be moved, bidirectionally, both along the guide (GR) and orthogonally to the latter.

Each mobile arm (BC) of the bridge crane (CP) is provided, at its free end, with a mobile hook (G) that, in turn, has the free end shaped as a hook to be easily positione under the body (31) of the handle (3). The hook (G) is hinged on the free end of the mobile arm (BC) by means of a pin with horizontal axis (PG) and has a rear side connected with a pneumatic spring (MP) by which the same hook (G) can be rotated about the hinge (PG) in the clockwise or anti-clockwise direction.

Figure 14:
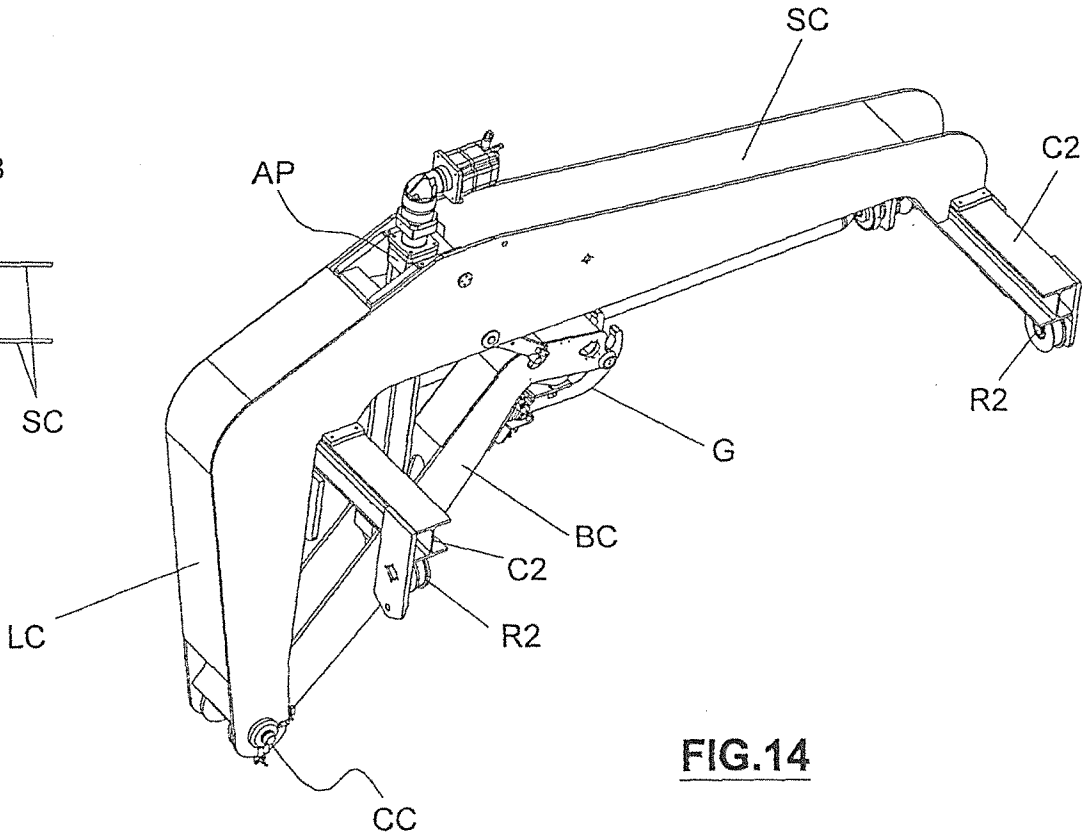
FIG. 14 is a perspective view of an arm of the bridge crane with its superstructure.

The rotation of each movable arm (BC) about the axis of the hinge (CC) is controlled by a respective actuator (AP) which has the skirt (100) attached to the superstructure (SC) and the stem (101) coupled to the movable arm (BC). More particularly, said skirt (100) is hinged to a bracket (102) by means of a horizontal pin (106). The latter on one side (right side in the drawings) is hinged on the superstructure (SC) by means of a pin (103) with a horizontal axis oriented orthogonally to the same superstructure (outgoing from the sheet). On the side opposite to the pin (103), on the superstructure (SC) is applied a load cell (104) in a fixed position below the free end (105) of the bracket (102). In other words, the load cell (104) is in a fixed position below the end (105) of the bracket (102) opposite the end of the same bracket that is hinged to the superstructure (SC) by means of the pin (103). As can be seen in the detail of FIG. 28, the said superstructure (SC) is box shaped, as the bracket (102) that is positioned between two sides of the superstructure (SC). The pin (103) extends transversely to the sides of the superstructure (SC), while the pin (106), which is parallel to the shaft (103), extends transversely to the sides of the bracket (102). As shown in FIG. 14, also the arms (BC) and the appendix (LC) are box-like shaped as the superstructure (SC). The pin (CC) that connects the movable arm (BC) with the appendix (LC) extends transversely to these elements. The actuator (AP) is placed between the sides of the arms (BC) and the superstructure (SC).

Three possible cases concerning the introduction phase of the pins (P) in the core (10) of the reel (1) are the following.

Case 1: the axis of the reel (1) is aligned with the axis (x-x) of the pins (P) and there are no significant changes in the weight on the load cell (104) during the introduction of the pins (P) in the reel core. This case is illustrated in FIG. 21 and FIGS. 22A-22B. In particular, in FIG. 22A the arm (BC) on the right is already introduced the respective pin (P) in the core (10) of the reel (1), while the arm (BC) of the left is still "open", that is, the respective pin (P) is out of the reel (1). In FIG. 22B both arms (BC) are "closed", that is, both pins (P) are inserted in the reel (1). It goes without saying, however, that the two arms (BC) can be moved as indicated by arrows "H" simultaneously.

Case 2: the axis of the core (10) of reel (1) is lower than, i.e. below, the axis (x-x) of the pins (P) and during the introduction of the pins these cause the lifting of the reel (1) so that the load cell (104) senses an increase of the weight value that exceeds a predetermined limit. In this case, the platform (PB) on which is placed the reel (1) corrects the position of the latter by lifting it, as further disclosed in the following, until the load sensed by the load cell is that due to the weight of the pins (P) only.

Case 3: the axis of the core (10) of reel (1) is higher than, i.e. above, the axis (x-x) of the pins (P) and during the introduction of the pins these are subject to lifting so that the load cell (104) senses a decrease of the weight value that exceeds a predetermined limit. In this case, the platform (PB) on which is placed the reel (1) corrects the position of the latter by lowering it, as further disclosed in the following, until the load sensed by the load cell is that due to the weight of the pins (P) only.

The disengagement of the pins (P) from the core (10) of the reel (1) will be obtained by moving the arms (BC) in a direction opposite to that shown by arrows "H" with the pins constrained to the hooks (G) of the same mobile arms.

For example, the platform (PB) can be raised and lowered by means of a pantograph mechanism disposed and acting under the same platform (PB). In this way, it is possible to adjust the height of the platform and, thus, the height of the core (10) of the reel (1) with respect to the pins (P) connected to the arms (BC) of the bridge crane (CP). Said mechanism comprises a lower base (200) and an upper base (201) joined by means of levers (202) hinged to each other and on the same bases (200, 201) and connected by an actuator (203). The latter, in a per se known manner, determines, when it is activated, the rotation of the levers (202) and, then, the lifting or the lowering of the upper base (201) on which is arranged the platform (PB). Consequently, it is obtained the lifting or lowering of the reel (1). It is understood that the mechanism for lifting/lowering the platform (PB) can be of any other type. For simplification, in FIGS. 1, 3 and 5 the mechanism for lifting/lowering the platform (PB) is not shown.

Figure 13:
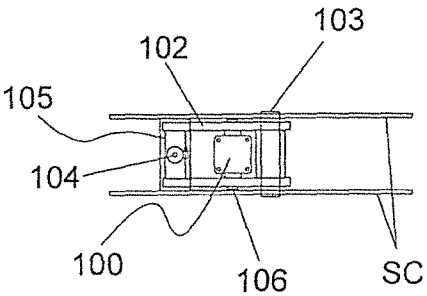
FIG. 13 is a schematic view from the above of an actuator (AP) and its connection to the corresponding superstructure (SC)

The bracket (102) and the load cell (104) constitute, according to the example described above, a possible embodiment of a device for detecting the load variations on the arms (BC) of the bridge crane (CP). Said device can be connected to a programmable unit (UP), as in the simplified diagram of FIG. 13, which controls the lowering or raising of platform (PB) by acting on the actuator (203) to cancel these variations.

The bracket (102) and the load cell (104) constitute, according to the example described above, a possible embodiment of a device for detecting the load variations on the arms (BC) of the bridge crane (CP). Said device can be connected to a programmable unit (UP), as in the simplified diagram of FIG. 30, which controls the lowering or raising of platform (PB) by acting on the actuator (203) to cancel these variations.

The bracket (102) and the load cell (104) constitute, according to the example described above, a possible embodiment of a device for detecting the load variations on the arms (BC) of the bridge crane (CP). Said device can be connected to a programmable unit (UP), as in the simplified diagram of FIG. 30, which controls the lowering or raising of platform (PB) by acting on the actuator (203) to cancel these variations.

Therefore, a device according to the present invention comprises a bridge crane (CP) with movable arms (BC) each suitable to engage a pin (P) insertable into a corresponding side of a reel (1) and a platform (PB) located below the said base (11) for supporting the reel (1); and comprises detection means adapted to detect load variations on said arms (BC) during insertion of the pins (P) in the reel (1), and movement means able to achieve a relative vertical movement between the reel (1) and the arms (BC) when the absolute value of a load variation detected by said detection means exceeds a predetermined limit, up to bring said value below the predetermined limit.

In accordance with the examples disclosed above:

said moving means are apt to vertically move the reel (1) with respect to the arms (BC);

said moving means comprise a mechanism for lifting and lowering said platform (PB);

said mechanism for lifting and lowering the platform (PB) is a pantograph mechanism;

said means for detecting the load variations on the arms (BC) comprise, for each arm (BC), a load cell (104) applied in a fixed position on a structure (SC) of the bridge crane (CP) to which the arms (BC) are connected, and a body (102) adapted to interfere with the load cell (104), each body (102) being connected to the respective arm (BC);

each body (102) is connected to the respective arm (BC) by means of an actuator (AP) that connects the same arm (BC) with said structure (SC);

said detection means and said movement means are connected to a programmable unit (UP) which receives electrical signals emitted by the detection means and controls the movement means and is programmed to actuate the movement means according to the signals emitted by the detection means;

the pins (P) are expandable pins.

It is understood that the above-mentioned correction can be implemented by lowering or raising the arms of the bridge crane and leaving the platform (PB) in a fixed position. In this case, the unit (UP) will be connected to the actuators (AP) to lower or raise the arms (BC) when, as previously mentioned, the load cell (104)—or another suitable detection device—detects a change of the load on the arms (BC) whose absolute value exceeds a predetermined limit, up to bring this value below the predetermined limit.

The means for detecting the load variation are also suitable to weigh the reel. In this way, it is possible to keep track of the amount of processed material, calculating the difference between the weight of the reel (1) at the origin and its weight at the end of the unwinding step.

Moreover, using a load cell suitably positioned with respect to the arms of the bridge crane, can be detected also changes in loads in the direction parallel to the axis of the reel (1). For example, with reference to the possible case illustrated in FIG. 31, the pin (P) is on the right and below the core (10): the variation of load in the direction parallel to the longitudinal axis of the reel during the approach of the arm carrying the pin (P) is greater than a predetermined limit (the pin P, in fact, is in a position in which it can not be inserted in the core of the coil 1). In such a condition, the control unit (UP) will command the stop of the arm which carries the pin (P) to prevent damages to the reel (1).

In practice the execution details may vary in any equivalent way in relation to the elements described and shown in the drawings, without departing from the adopted solution idea and then remaining within the limits of the protection granted by the present patent.

The invention claimed is:

1. A device for handling paper reels, the device comprising:

a bridge crane with movable arms, each of the movable arms being adapted to engage a pin insertable into a corresponding side of a reel and a platform adapted for supporting the reel;

a detection means for detecting load variations on said movable arms during insertion of the pins inside the reel; and a moving means for providing a relative movement between the reel and the movable arms when an absolute value of a variation of a load detected by said detection means exceeds a predetermined limit up to bring said absolute value below the predetermined limit.

2. A device according to claim 1, wherein said moving means is adapted to move vertically the reel with respect to the movable arms.

3. A device according to claim 1, wherein the detection means for detecting the load variations on the movable arms comprises, for each movable arm, a load cell applied in a fixed position on a structure of the bridge crane to which the movable arms are connected, and a body adapted to interfere with said load cell, each body being connected to a respective movable arm.

4. A device according to claim 3, wherein each body is connected to the respective movable arm by an actuator that connects the respective movable arm with the structure.

5. A device according to claim 1, wherein said detection means and said moving means are connected to a programmable unit which receives electrical signals produced by the detecting means and the programmable unit controls the moving means and the programmable unit is programmed to actuate the moving means based on the signals produced by the detection means.

6. A device according to claim 1, wherein each pin is an expandable pin.

7. A device according to claim 1, wherein said variation of the load is one or more of vertical and horizontal.

8. A device according to claim 1, wherein said detection means is adapted to weigh the reel.

* * * * *